US005644942A

United States Patent [19]

Bradbury

[11] Patent Number: 5,644,942

[45] Date of Patent: Jul. 8, 1997

[54] ROLL STAND RAFT ASSEMBLY

[75] Inventor: Philip E. Bradbury, McPherson, Kans.

[73] Assignee: The Bradbury Company, Inc., Moundridge, Kans.

[21] Appl. No.: 323,139

[22] Filed: Oct. 14, 1994

[51] Int. Cl.[6] ..... B21B 31/02

[52] U.S. Cl. ..... 72/238; 72/181

[58] Field of Search ..... 72/234, 235, 238, 72/239, 181, 237

[56] References Cited

U.S. PATENT DOCUMENTS

| | | | |
|---|---|---|---|
| 1,125,984 | 1/1915 | Dumas | 72/181 |
| 2,561,634 | 7/1951 | Piction | 72/181 |
| 3,823,592 | 7/1974 | Colbath | 72/181 |
| 5,113,682 | 5/1992 | Poloni | 72/238 |

FOREIGN PATENT DOCUMENTS

| | | | |
|---|---|---|---|
| 1777039 | 10/1971 | Germany | 72/181 |

*Primary Examiner*—Lowell A. Larson
*Assistant Examiner*—Thomas C. Schoeffler
*Attorney, Agent, or Firm*—Marshall, O'Toole, Gerstein, Murray & Borun

[57] ABSTRACT

A raft assembly in the roll forming art having a plurality of forming roll stands including a combined horizontal raft plate and first vertical stand formed together in an L-shaped single cast. The first vertical stand supports multiple station pairs of spindles at one end thereof and a plurality of second vertical stands each of which supports the opposite ends of a said pair of spindles on a single roll stand and bolts for attaching the second vertical stands to the raft plate oppositely positioned from said first vertical stand.

6 Claims, 2 Drawing Sheets

ROLL STAND RAFT ASSEMBLY

FIELD OF INVENTION

This invention relates to roll forming machines. Elongated sheet metal workpiece moves lengthwise along a defined path between pairs of forming rolls in roll stands which produce progressive bends in the workpiece that extends along its length; the invention more particularly is concerned with the raft assembly design that supports the pairs of forming rollers and raft assembly's ability to convert from one production workpiece to another with a minimum tool change time.

BACKGROUND OF THE INVENTION

The forming rolls on a roll forming machine are arranged in pairs with each pair being supported on spindles or tooling arbors which in turn are supported at their ends by vertical stands. Initially the vertical stands were separate parts which were each releasably attached to a machine base. However, each time the tooling was changed there was required a total disassembly and reassembly of the vertical stands, their contained spindles and the forming rolls on those spindles. This was very time consuming and particularly the precise alignment of all of the re-assembled stands.

Designers then combined the two vertical stands in an integral u-shaped structure, next they provide a plurality of stands on a horizontal raft plate which allowed the total raft to be removed intact without any disassembly. The raft assembly now involved a u-shaped structure which supported the forming rolls and spindles which did not require disassembly each time they were removed from the roll forming line. The current prior art raft design includes three separate pieces, two vertical stands joined by a horizontal raft plate to which they are both bolted.

SUMMARY OF THE INVENTION

The present invention simplifies the design of a raft assembly by casting the raft plate and the left stand in a single piece thus eliminating substantial machining, attachment means and labor. The left vertical stand or inboard side of the raft assembly is cast with the horizontal raft plate as a single piece and includes a machined bearing surface on its outboard side for mounting the right vertical stand to the horizontal rafting plate through releasable attachment means. The bottom surface of the raft plate also includes bearing surfaces for attaching the overall raft assembly to the base of the machine.

It is therefore the principal object of the present invention to provide a new and improved raft assembly of a more simplified design and less cost in construction.

DESCRIPTION OF THE PREFERRED EMBODIMENT

Figure 1:
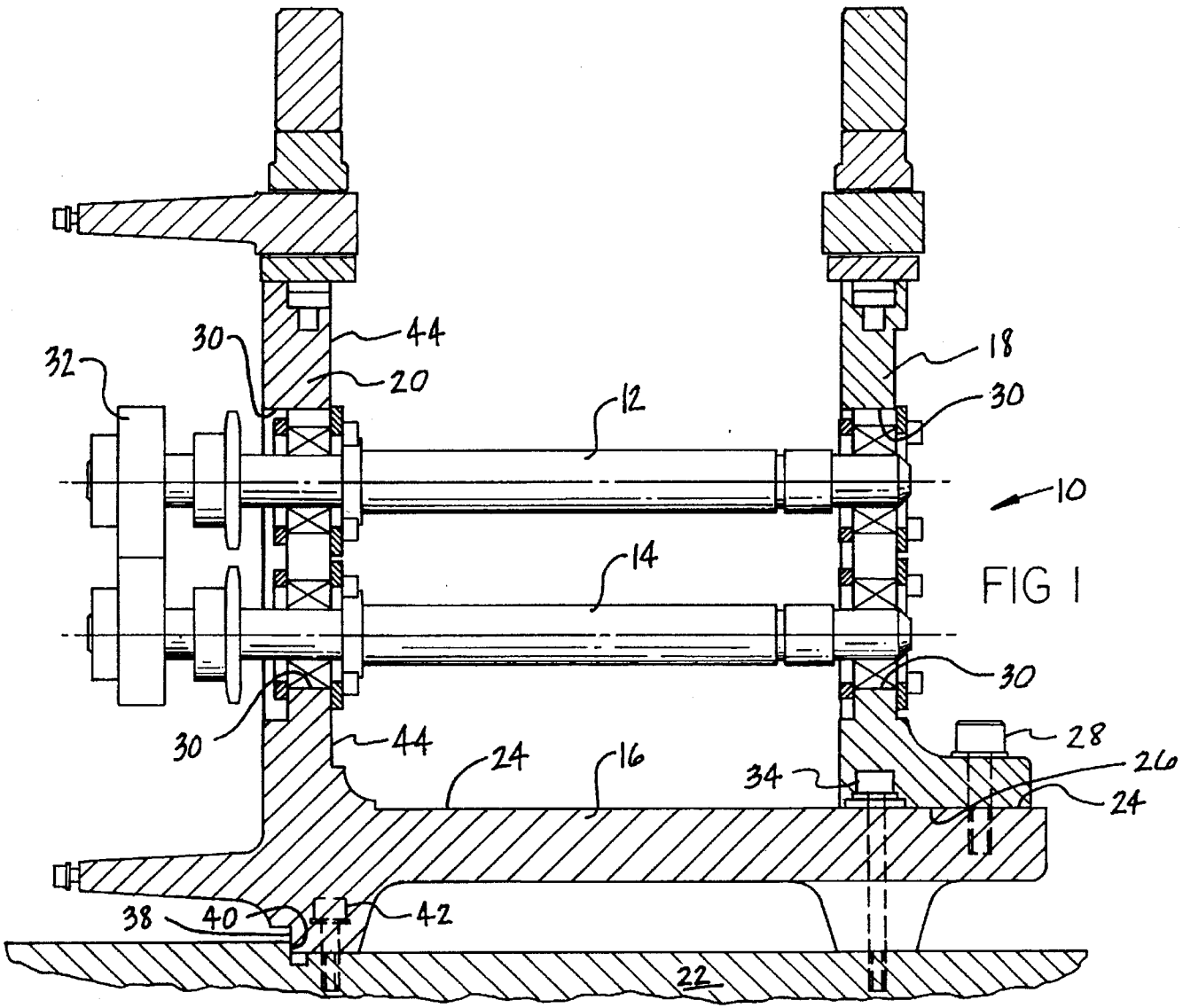
FIG. 1 is an end elevational view of the raft assembly partially in cross section with the forming rolls and drive means not shown.

With reference to FIG. 1, the overall raft assembly of the present invention is generally described by reference numberal 10. It is u-shaped including a horizontal raft plate 16 and two vertical stands 18 and 20. Left vertical stand 20, also referred to as the inboard stand, is integrally formed or cast with the horizontal raft plate 16. The right vertical stand 18 is essentially identical to inboard stand 20 except that it is separately formed and is bolted to raft plate 16 by bolts 28. Stand 18 includes a foot 36 having a machined-bearing surface 26. Raft plate 16 includes a corresponding bearing surface 24 for attachment of stand 18 which provides precise alignment between the vertical stands. Both stands 18 and 20 include machined-bearing support areas 30 which in turn support a pair of spindles 12 and 14. Carried on spindles 12 and 14 are forming rolls of various shapes which are not shown in the drawing. The bearings for spindles 12 and 14 are conventional and are not shown in detail. The bearings on upper spindle 12 are carried in bearing blocks which provide vertical fine adjustment between the forming rolls which is not a part of this invention.

Figure 2:
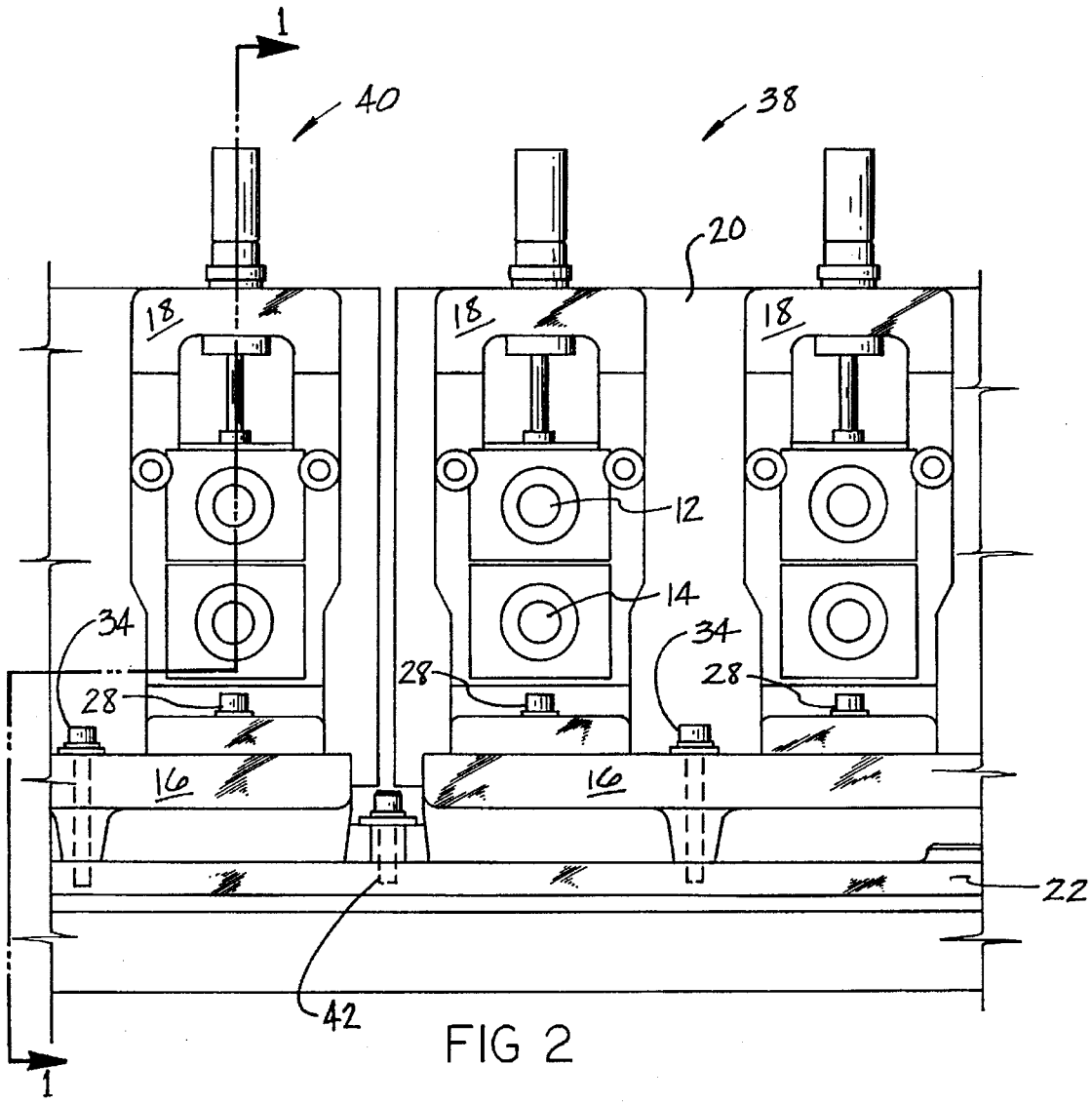
FIG. 2 is a side elevational view of a portion of two raft assemblies on a roll forming line of the present invention with portions of the rafts broken away.

While FIG. 1 illustrates only a single pair of spindles, the raft assembly 10 is intended to include multiple stations or roll stands. FIG. 2 of the drawing illustrates portions of two raft assemblies positioned end-to-end. Raft assembly 38 includes four stations, only two of which are shown and are anchored in place by a pair of bolts 34, one of which is not shown. The alignment of the raft assembly 10, as shown in FIG. 1, is provided by a reference shoulder 40 cut in the base plate 22 of the machine. The inboard vertical stand 20 includes a cutout groove 38 along its length which mates with reference shoulder 40. The inboard side of the raft assembly 10 is restricted from any vertical movement by a bolt and washer 42, as shown in FIG. 2.

The inboard stand 20 has a machined surface 44 which in light of its unitary structure provides better alignment for the roll forming stations than separate individual stands.

When a tooling change is required on the roll forming line, bolts 34 and 42 are removed whereupon the overall raft assembly is lifted out of the line. The number of roll stands or stations in each raft assembly is limited only by the lifting capacity of the crane. Raft assemblies can include from one roll stand upwards to any number depending upon their overall size and weight.

The two-piece raft assembly of the present invention is formed of cast metal, however, it might also be fabricated from sheet metal.

Since many possible embodiments may be made of the invention without departing from the scope thereof, it is understood that all matter herein set forth in the accompanying drawings is to be interpreted as illustrated and not in a limiting sense.

What is claimed is:

1. A removable raft assembly utilized in roll forming lines for supporting multiple spindle stations and their associated forming rolls comprising:

a combined horizontal raft plate and a first vertical stand formed together in an L-shaped single cast, the first vertical stand including bearing supports for multiple station spindles, the raft plate including machined bearing surfaces for attaching a second vertical stand; and a plurality of second vertical stands having bearing supports for selected ones of said multiple spindles and having a machined bearing surface for attachment to said raft plate.

2. A raft assembly as set forth in claim 1 wherein the first vertical stand supports a plurality of pairs of forming rolls and each of the second vertical stands support a single pair of forming rolls thereon.

3. A raft assembly as set forth in claim 1 wherein the first vertical stand has a vertically machined planar surface extending longitudinally along its length to provide reference plane for alignment for the forming rolls on each station on the raft plate.

4. A raft assembly as set forth in claim 1 including a horizontal base plate having a raft alignment means thereon and means for releasably mounting the raft assembly to said horizontal base plate.

5. A raft assembly as set forth in claim 4 wherein the means for releasably mounting the raft assembly is positioned along one edge of the raft plate.

6. A raft assembly as set forth in claim 4 wherein the means for releasably mounting the raft assembly is positioned along one edge and the raft alignment means is positioned along an opposite edge.

* * * * *